US005212898A

United States Patent [19]

Dinan et al.

[11] Patent Number: 5,212,898

[45] Date of Patent: May 25, 1993

[54] POLE SIGN CONSTRUCTION

[75] Inventors: James M. Dinan, Irvington, N.Y.; Paul J. Dinan, Westfield, N.J.

[73] Assignee: Dinaco, Inc., Irvington-on-Hudson, N.Y.

[21] Appl. No.: 725,989

[22] Filed: Jul. 5, 1991

Related U.S. Application Data

[63] Continuation-in-part of Ser. No. 509,575, Apr. 16, 1990, abandoned.

[51] Int. Cl.[5] ..... G09F 15/00

[52] U.S. Cl. ..... 40/607; 40/611; 411/389; 411/908; 248/219.4

[58] Field of Search ..... 40/603, 604, 606, 607, 40/611; 411/389, 525, 526, 527, 908; 248/219.1, 219.4; 403/408.1

[56] References Cited

U.S. PATENT DOCUMENTS

| | | | |
|---|---|---|---|
| 1,225,420 | 5/1917 | Eggert | 411/525 X |
| 2,899,764 | 8/1959 | Oberlin, Jr. | 40/607 X |
| 3,182,414 | 5/1965 | Snediker | 40/607 X |
| 3,217,437 | 11/1965 | Cobb | 40/607 X |
| 3,310,899 | 3/1967 | Hart et al. | 40/604 |
| 3,479,760 | 11/1969 | Snyder et al. | 40/607 |
| 3,778,956 | 12/1973 | Martin | 411/389 X |
| 3,824,724 | 7/1974 | Miller et al. | 40/607 X |
| 4,298,291 | 11/1981 | Ward, Jr. | 403/205 |
| 4,729,707 | 3/1988 | Takahashi | 411/389 |
| 4,977,697 | 12/1990 | Genick | 40/606 |

*Primary Examiner*—Kenneth J. Dorner
*Assistant Examiner*—Brian K. Green
*Attorney, Agent, or Firm*—Schweitzer Cornman & Gross

[57] ABSTRACT

A pole sign construction comprising a vertical pole support;

pairs of upper and lower brackets secured to the pole and having outwardly projecting aligned bolts; a pair of rectangular base sign boards of corrugated plastic material having a series of connecting holes formed in their lateral edges; a plurality of first clear plastic locking washers and clear plastic bolts connecting the corrugated sign boards in back-to-back relation around the vertical pole; spaced pairs of mounting holes formed in the upper and lower edges of each of the corrugated sign boards; locking washers securing the boards to the brackets on the projecting bolts, the bolts passing through the upper and lower mounting holes;

overlay sign boards congruent with the base sign boards and secured to the plastic bolts with second clear plastic locking washers.

1 Claim, 5 Drawing Sheets

POLE SIGN CONSTRUCTION

RELATION TO PENDING APPLICATION

This application is a continuation in part of copending application Ser. No. 509,575 filed Apr. 16, 1990 now abandoned.

BACKGROUND OF THE INVENTION

The present invention relates in general to inexpensive, but durable, back-to-back display signs for use outdoors and, more particularly for use in fast food restaurants; automotive filling stations; and the like.

The construction of the present invention is particularly well suited for promotional advertising signs, which are displayed outdoors, requiring changes from time to time to reflect new prices, new products, or other new messages. Heretofore, these types of signs have been mounted o display racks and/or on vertical poles in prominent positions so as to be readily viewed by the passing public. It is desired that signs of this general type be replaced simply and easily and at low cost so as to display new and/or more current advertising messages as the need arises. In addition, it is important that signs of this type be capable of low cost manufacture and sale at reasonable costs to the ultimate marketing consumer, and that the advertising messages to be displayed by the signs be changeable quickly, easily, and without the requirements of high skilled labor or the requirements of special tooling.

The changeable sign messages themselves have heretofore been printed on cloth, reinforced papers and plastic films. Whatever the particular medium of the sign, it is critical that it be capable of withstanding the effects of weather, i.e., extremes in temperature, precipitation, as well as high winds.

The present invention provides a new and improved, knocked down and easy to ship, inexpensive sign, especially well suited for pole mounting, which satisfies to great advantage all of the foregoing criteria. It will be appreciated from the following summary of the invention and detailed description of the same that the new display sign of the invention provides for readily changeable displays of back-to-back advertising panels on a single pole, which advertising panels may be erected quickly and simply without skilled labor or special tools, and which sign is relatively rigid while being light weight, durable, and of low cost.

SUMMARY OF THE PRESENT INVENTION

The new and improved pole sign of the present invention consists of several simple but effective elements, namely, a one-piece upper sign engaging bracket support unit; a lower sign-engaging bracket support unit and a foldable, corrugated plastic board sheet material which is mounted at its upper and lower edges on the aforementioned bracket support units; and conventional strap mounts or new and improved clear plastic bolts and stop nuts or washers for affixing said upper and lower support units in spaced relation to a vertical pole.

In accordance with the principles of the present invention, two large, unfolded, corrugated plastic board sign sheets, which may be folded for compactness during shipment, are connected along their vertical side edges, one to the other, in back-to-back relation by a series of plastic locking ties or new and improved clear plastic bolts (with associated stop nuts or washers) passing through registered connection holes. The top and bottom edges of the sign board sheets have mounting holes through which projecting horizontal supporting bolts, extending from pole supported hardware, are employed for securing the sign board sheets. Wing nuts are used to fasten the corrugated plastic board sheets to the hardware and thus to the pole.

In accordance with the invention, new or updated replacement messages may be superimposed upon the original corrugated board sign by printing the same on large flexible, laminated plastic sheets congruent with the plastic boards and securing the same thereto with additional plastic locking ties passing through the registered and tied holes of the back-to-back support boards or with additional clear plastic lock nuts or washers.

As a specific feature of the new sign construction, a special bracket may be employed to make changing of the sign messages easier and safer.

For a greater understanding of the principles of the present invention, and better appreciation of the many advantages to be obtained from the practice of the invention, reference should be made to the accompanying drawings taken in conjunction with the following detailed description.

DETAILED DESCRIPTION OF THE PRESENT INVENTION

Figure 1:
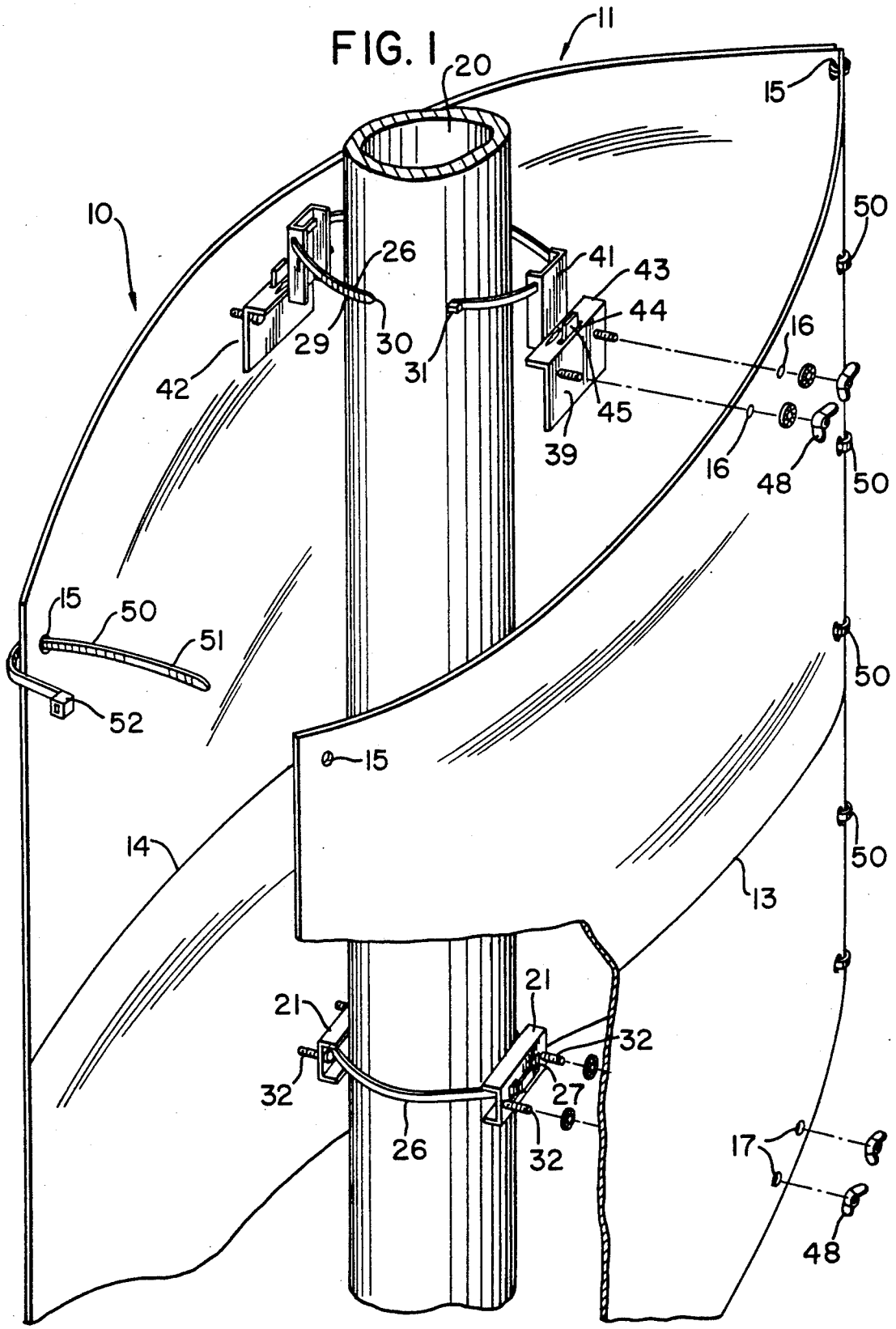
FIG. 1 is an exploded perspective view of the new and improved corrugated plastic board display sign of the invention, having back-to-back signage, shown mounted on a vertical pole.

Referring now FIG. 1, the new sign construction 10 of the present invention generally comprises a pair of large flat semi-rigid base sheets 11 and 12 which are fabricated from corrugated plastic (hollow with spaced internal ribs 9) material of 3 mm thickness having both strength and sufficient flexibility to be bowed as shown, but also having enough rigidity in the vertical plane so as to retain its integrity in high winds. This corrugated plastic material also lends itself to being folded for shipment and storage. To that end, each of the sign board sheets 11 and 12 is divided by one or more score lines 13 and 14 so that the corrugated sheets may be shipped in reduced overall size. Typically, the sign board sheets 11 and 12 are approximately three feet wide by four feet high, although the sizes may be adjusted as found desirable or necessary for a particular application.

In accordance with the invention, a series of connection holes 15 are formed along the vertical side edges of the sheets 11 and 12; in addition, a spaced pair of mounting holes 16 and 17 are formed at the upper and lower edges respectively of the sheets 11 and 12.

Figure 5:
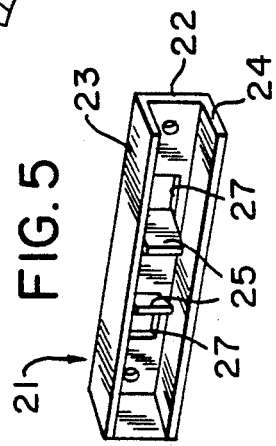
FIG. 5 is a perspective view of the lower bracket support hardware of the invention.

The sign boards 11 and 12 are assembled and fastened to a vertical pole 20 in the following manner. A pair of lower brackets 21 which are in the form of horizontal channel members having a vertical front wall 22, an upper horizontal wall 23, and a lower horizontal wall 24, as well as two intermediate reinforcing walls 25 extending inwardly from the front wall 22 are secured to a lower portion of the pole 20 in spaced relation by a metal fastening strap 26 which passes through openings 27 formed in the front wall of the brackets 21 as shown in FIGS. 1 and 5. The locking straps 26 have free ends 30 including male ratchet teeth 29 which pass through and are locked with female locking members 31 formed on the opposite free end thereof. The locking straps 26 having the mating ends 30 and 31 are standard bracket mounting hardware for signs of this type, which typically include cooperating self-locking ratchet-type mechanisms incorporated into the ends of the straps 26. The lower brackets 21 each have a pair of mounting bolts 32 projecting outwardly therefrom as shown in FIG. 1. The lower brackets are advantageously mounted to the pole 20 approximately five to six feet above ground level.

Figure 5A:
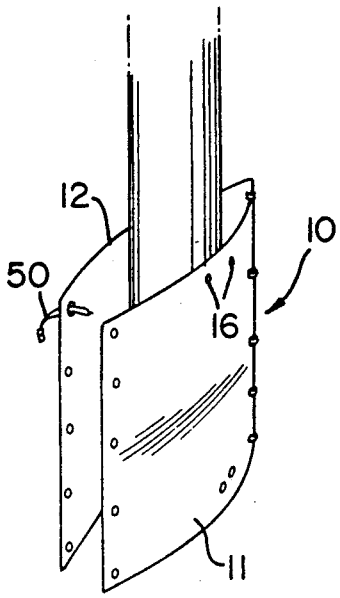
FIGS. 5A, 5B, 5C and 5D are sequential perspective views illustrating the steps of assembling and erecting the back-to-back sign of the present invention.

After the lower brackets 21 are secured to the pole, the front and rear panels 11 and 12 are superimposed one on the other so that the connecting holes 15 are in registry. Then the first pair of side edges of the superimposed panels 11 and 12 are secured one to the other by lightweight plastic locking ties 50 having male ratchet teeth 41 which pass through a female locking end 52 in a ratchet-like locking arrangement, somewhat similar to that of the metallic locking straps 26. The free ends 51 are threaded through the registered openings 15 and are pulled taught through the locking members 52 to tie the edges together along one side. Excess projecting portions of ties 50 are trimmed for neatness in appearance. After one side is connected, the semi-assembled front and rear panels 11 and 12 are wrapped around the pole 20 as shown in FIG. 5A.

Figure 3:
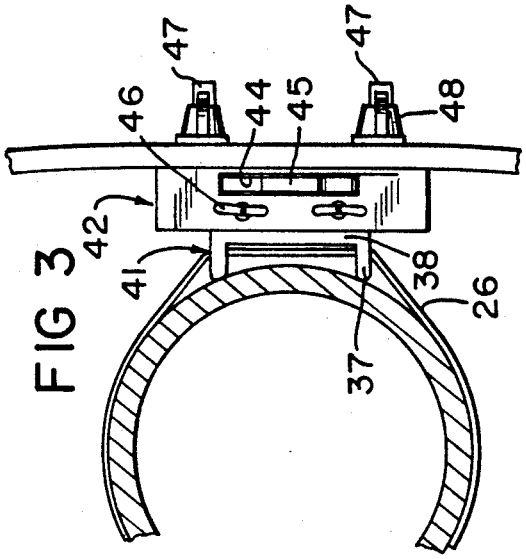
FIG. 3 is a horizontal cross-sectional view showing the upper bracket support of the invention.
Figure 4:
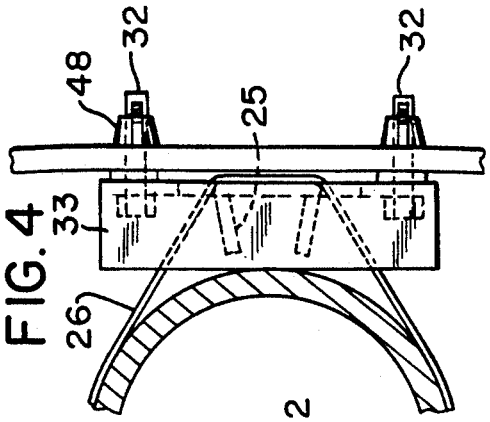
FIG. 4 is a cross-sectional view showing the lower bracket support of the invention.
Figure 2:
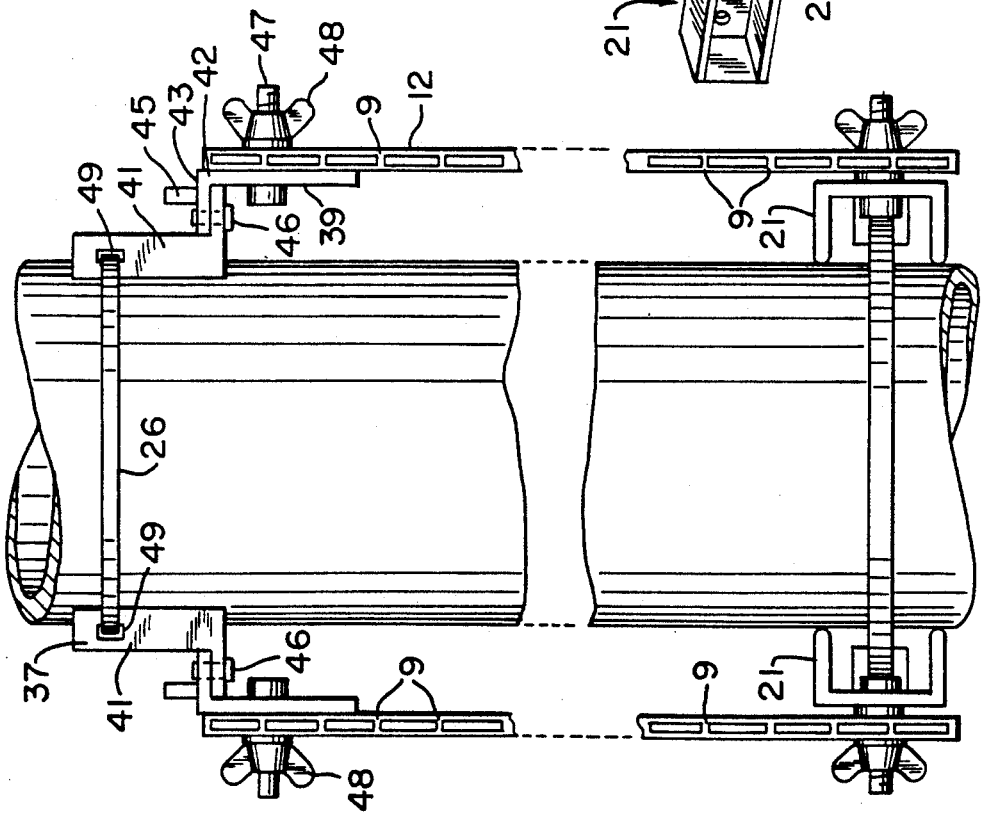
FIG. 2 is cross-sectional view showing the sign mounting hardware of the invention.
Figure 5B:
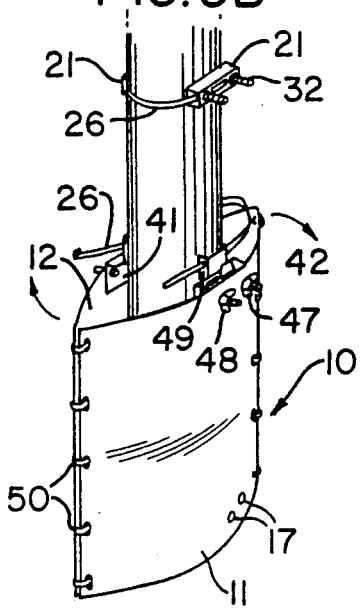

At this point, the upper hardware connectors 41 are attached to the connected sign panels 11 and 12 while those panels are on the ground as illustrated in FIG. 5B. More specifically, the upper hardware for the sign comprises a pair of upper shallow U-shaped support units 41 which are directly secured to the pole by an upper pole strap 26 identical in construction to the pole strap 26 used to secure the lower sign support members 21 described hereinabove and upper sign engaging hardware 42 which is illustrated in FIGS. 2 and 3. The units 41 include a web 38 and flanges 37 with slots 49 through which straps 26 pass. The hardware 42 generally includes a horizontal flange 43 and a vertical wall member 39 connected in L-shape form as shown in FIG. 2. A slot 44 is formed in the flange 43 in a manner whereby the slot 44 will accommodate a vertical tongue 45 which projects upwardly from the pole engaging hardware 41. The bracket 42 is temporarily fastened to the bracket 41 by fasteners 46 which may be in the form of conventional brass spreadable fasteners of the type used to connect several pages of paper. The hardware 42 further includes a pair of forwardly projecting bolts 47 which are spaced so as to support the mounting holes 16 and 17 of the upper edges of the sheets 11 and 12 as will be understood.

With the sheets 11, 12 around the pole (FIG. 5B) the other side edges are connected by ties 50 in the manner described hereinabove. Thereafter, the upper edges of the sheets 11 and 12 are placed over the projecting bolts 47 and are fastened through holes 16 to the hardware 42 by wing-nuts 48. At this point, as illustrated in FIG. 5B, the connected signs 11 and 12 have the upper hardware 41 and 42 connected thereto. The pole strap 26 is passed through openings 49 formed in the upper portions of the bracket support units 41.

Figure 5C:
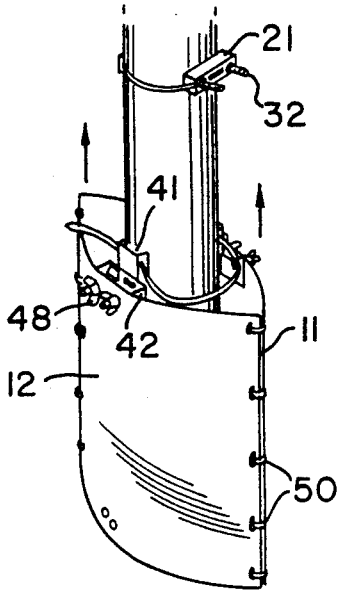
Figure 5D:
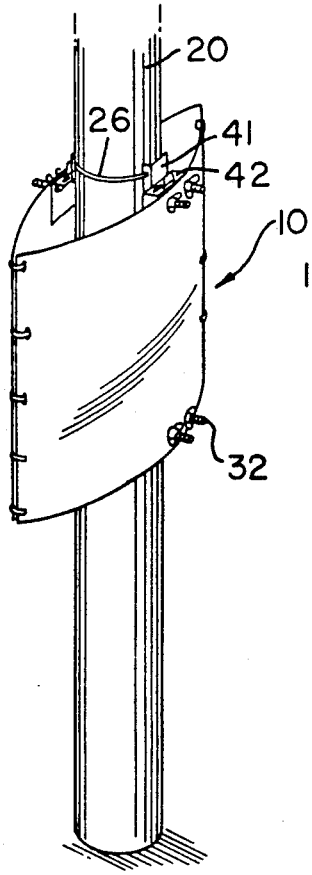

As shown in FIG. 5C, the connected signs 11 and 12 with the upper sign engaging hardware 41 and 42 mounted thereto by wing-nuts 48 is then rotated ninety degrees with respect to the pre-installed lower hardware 21 so that the assembled back-to-back signage may be passed over the hardware 21 and up the pole to a point where the lower holes 17 are aligned with the bolts 32 which project from the hardware 21 (FIG. 5D). At this point, as shown in FIG. 5D, the upper strap 26 is tightened to secure the upper pole brackets 41 directly to the pole 20 (this while the hardware 42 is temporarily fastened thereto by the fasteners 46), while the lower mounting holes 17 are placed over the projecting lower bolts 32. At this point, the additional wing-nuts 48 are used to secure the lower edges of the sign to the projecting bolts 32. Thereafter the temporary fasteners 46 are removed from the upper bracket hardware 41, 42 to permit the subsequent changing of the sign as to be described hereinafter.

Figure 5E:
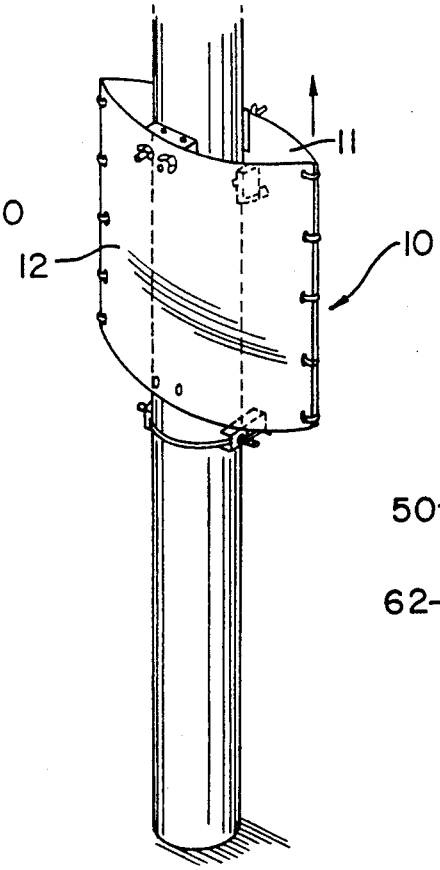
FIGS. 5E and 5F are sequential perspective views illustrating the assembly of an overlay sign with a replacement message on the underlying corrugated board support sign.
Figure 5F:
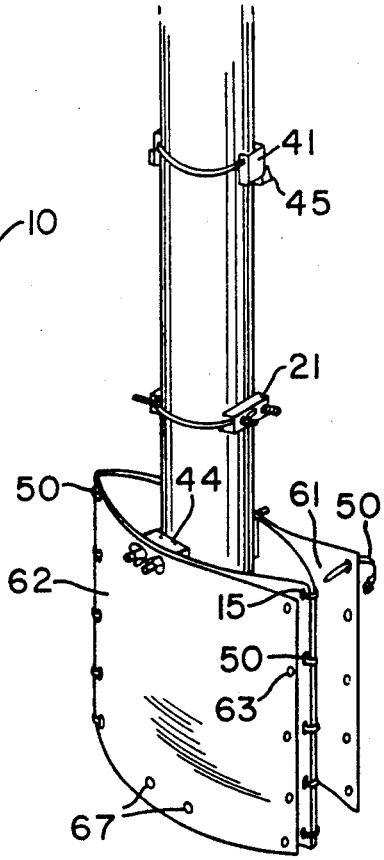

It is an important feature of the present invention that the sign message which is printed or silk-screened on the support board 11 and 12 may become dated or it may become otherwise necessary to change the message. In accordance with the principles of the invention, the sign 10 may be readily revised as follows. The connected back-to-back sign boards 11, 12 are pushed slightly upwardly of the pole to disengage the tongues 45 from the slots 44 (after removing the fastening wing nuts 48 from the bottom projecting bolts 32). More specifically, as shown in FIG. 5E the back-to-back support boards 11, 12 are freed from attachment to the lower brackets 21 by removing the wing nuts 48 securing the sign boards 11, 12 to those brackets through the holes 17. The back-to-back signs are then bowed by applying pressure to the side edges of the boards 11, 12 to free the sign from engagement with the projecting bolts 32; then the back-to-back signs are rotated 90 and pushed upwardly of the pole to disengage the slots 44 of the upper hardware brackets 42 from the tongues 45 formed on the brackets 41 directly mounted to the pole. With the sign boards 11, 12 thus disengaged from the upper and lower pole brackets 21, 41 the support boards are slid down the pole to the ground as shown in FIG. 5F.

In accordance with the principles of the invention, a simple light weight overlay sign comprising overlay sheets 61, 62 containing a new message printed or silk-screened on flexible sheet material which is light weight and which may be rolled up for shipment to the pole sign site. This overlay sheet material 61, 62 is sized and shaped to be congruent with the corrugated support boards 11, 12 (typically 44 inches wide by 70 inches high) and includes auxiliary mounting holds 63 which are in registry with the mounting holes 15 on the sign board support sheets 11, 12. The material for the overlay sheets 61, 62 is advantageously bleached sulfite board of 0.024 inches thickness having a 1 mil layer of white polyethylene on one side and a 1 mil layer of oriented polypropelyene on the other side. The edges of the overlay sheets 61, 62 are suitably waterproofed.

The signage of the underlying support boards 11, 12 thus may be quickly changed by placing the flexible sheets 61, 62 thereover and affixing the overlay sheets 61, 62 to the underlying support boards 11, 12 by utilizing ties 50 identical in construction to those described and illustrated hereinabove in connection with the illustration shown in FIG. 1. The new message is thus affixed by a series of ties which pass through the registered holes 63, 15. These extra ties 50 are in superimposed relation with the ties 50 which were in place in the original connection of the boards 11, 12 to one another in back-to-back relation, as will be understood. The free edges of the extra ties 50 may be trimmed to eliminate excess protruding portions.

The sign 10 is then re-erected by sliding it back up the pole over the lower hardware 21 and the upper hardware 41 until the slot 44 in the bracket 42 is adjacent to the tongue 45. The supporting sides 11, 12 are then rotated so that the slots 44 may be engaged with the tongues 45 and so that the lower holes 17 and lower holes 67 formed in the overlay sheet 63, 63 are reregistered with the lower projecting bolts 32. The sign 10 is then securely reinstalled by fastening wing nuts 48 to the projecting bolts 32 as will be understood.

Figure 6:
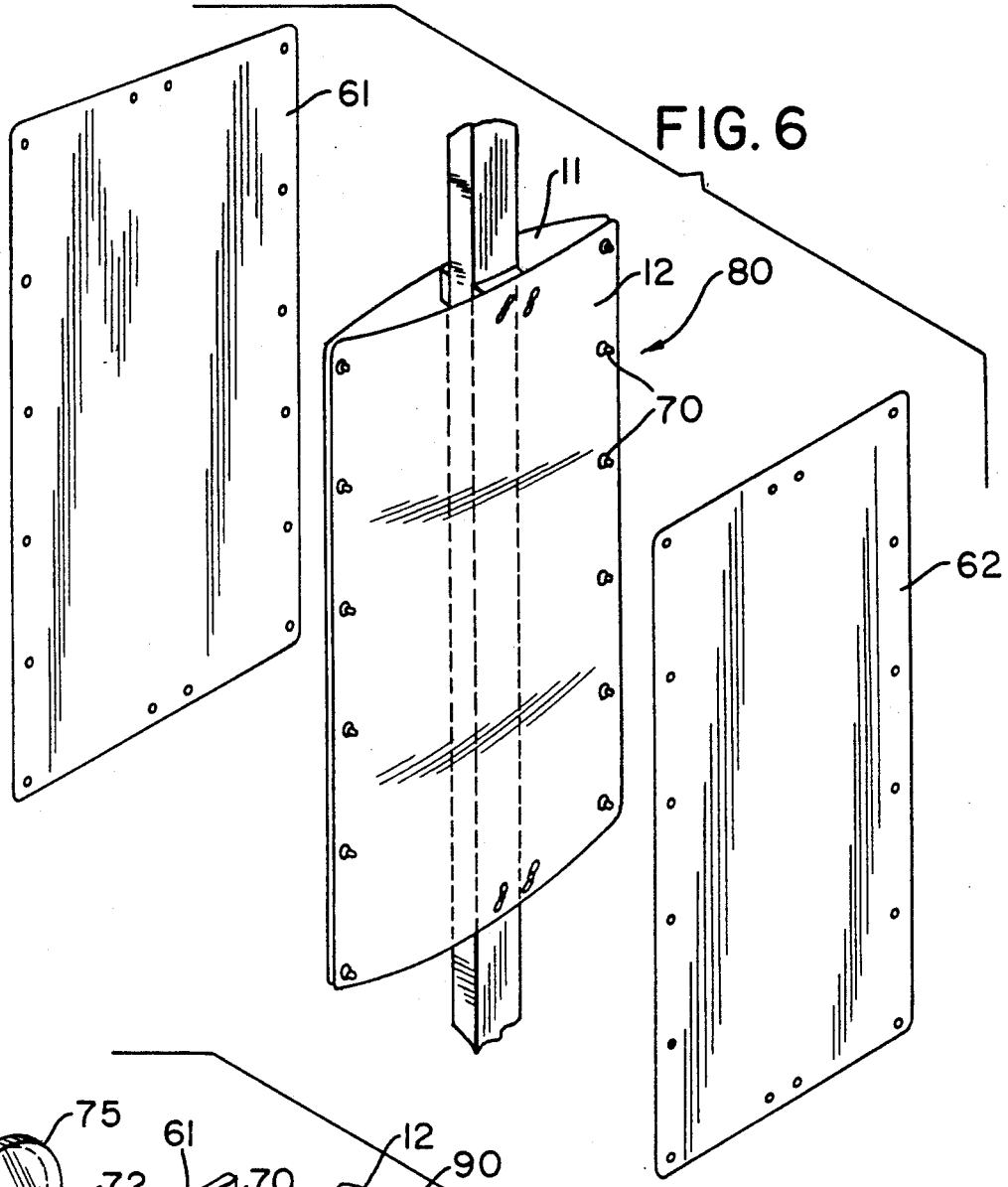
FIG. 6 is a perspective view of a preferred alternate embodiment of the invention utilizing clear plastic bolts and stop nuts in lieu of plastic straps.
Figure 7:
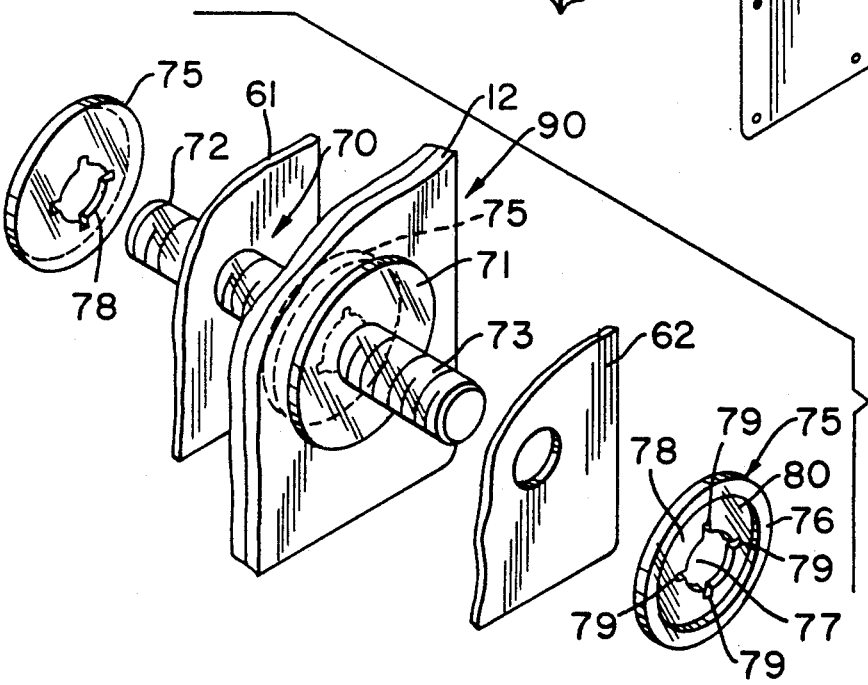
FIG. 7 is an enlarged exploded view of the new clear plastic lock nut/bolt arrangement.
Figure 8:
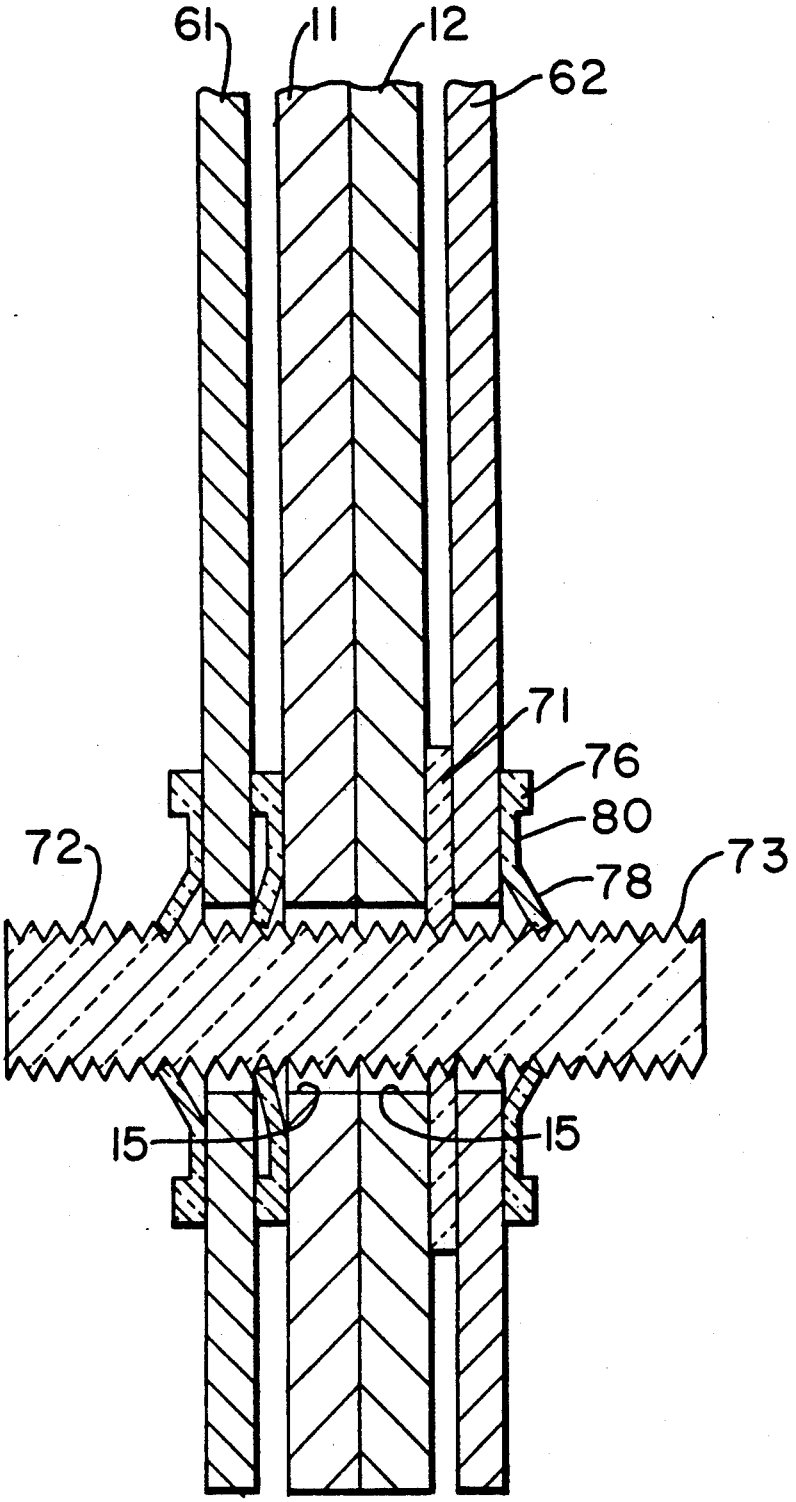
FIG. 8 is an enlarged cross-sectional view showing details of construction of the preferred alternate embodiment.

In lieu of the plastic ties 50, shown in FIGS. 1 and 5A–5F, a preferred and further improved pole sign construction may be assembled utilizing new and improved clear plastic bolt members 70 having an integral intermediate annular flange 71 disposed slightly off-center between the threaded opposite ends 72, 73 of the member 70, as shown in FIGS. 6–8.

The sign 90 shown in FIGS. 6–8 is generally assembled and erected as the sign 10 shown in FIGS. 1–5F and described hereinafter. However the base sheeets 11, 12 are interconnected a shown in FIG. 6–8 by the new clearrr plastic bolts 70 and associated clear plastic annular lock nuts 75 having aa circumscribing rim 76, and flexible locking teeth 78 formed in the washer body 80 by slits 79, the teeth 78 defining aa bore 77. The lock nuts 75 may be pressed over the ends 72, 73 of the bolts 70 as shown in FIG. 8 to fasten the base sheets 11 and 12 together as well as to secure quickly and simply the overlay sheets 61, 62 to the base sheets 11, 12.

More specifically, the new bolts 70 are approximately 1.5 inches in length and approximately 0.25 inches in diameter. The flange 71 is approximately 0.75 inches in diameter and approximately 0.10 inches in thickness. Furthermore, the flange is integral with the threaded bolt portions 72, 73 being located closer to the end 73 than to the end 72. Thus the sheets 11, 12 may be secured to each other, as shown in FIG. 8, by pushing the end 72 through the aligned holes 15 of the sheets 11, 12 until the flange 71 engages the face of the sheet 12. Pushing lock nut 75 over the free end 72 up against the face of sheet 11 will fasten the sheets together as will be understood. The lock nuts 75 may be unthreaded from the bolts 70 should it be desired to disconnect the sheets 11, 12.

In accordance with the invention, when the messages of sheets 11, 12 are to be changed, the overlay sheets 61, 62 may be superimposedd on the base sheets 11, 12 and fastened by push nuts 75 as will be understood. Importantly, the lock nuts and plastic bolts are transparent and therefore are essentially invisible. This permits the signage to be displayed without interference from the fasteners, and, indeed, it permits the signage to be seen through the transparent lock nuts 75. Moreover, the visual appearance of the signs is not compromised nor is it detracted by the transparent fasteners 70, 75.

It will be appreciated that the sign of the present invention may be manufactured and shipped at low cost in a compact, knock-down package and assembled with unskilled labor in short order at any desired location having a vertical pole, such as a fast food restaurant, filling station, or the like. The fundamental underlying back-to-back sign is durable and lends itself to attractive display while being light weight and of low cost, and easy to erect. Moreover, it may be changed simply and efficiently, with unskilled labor, and at low cost by the application of light weight overlay signs utilizing simple plastic ties.

It will be apparent to those skilled in the art from the preceding description, that certain changes may be made in the foregoing sign apparatus without departing from the scope of the invention. Accordingly, it is intended that the descriptive matter hereinabove shall be interpreted as illustrative and in no way limiting, since all equivalents within the scope of this disclosure may be substituted and such substitution is intended to be embraced in the following claims.

We claim:

1. A pole sign construction comprising (a) a vertical pole support means;

(b) paris of upper and lower bracket means secured to said pole support means and having outwardly projecting fastening means;

(c) a pair of rectangular base sign boards of corrugated plastic material having a series of first connecting holes formed in lateral edges thereof;

(d) a plurality of transparent plastic locking means connecting said sign boards in back-to-back relation around said vertical pole support means.

(e) spaced pairs of mounting holes formed in upper and lower edges of each of said base sign boards;

(f) said fastening means passing through said upper and lower mounting holes;

(g) first locking means securing said base sign boards to said brackets on said projecting fastening means;

(h) changeable message overlay sheets having second connecting holes congruent with the first connecting holes of said base sign boards; said overlay sheets are superimposed with and connected by the transparent plastic locking means to said base sign boards;

(i) said overlay sheets are fabricated from corrugated laminated material; and (j) said transparent plastic locking means includes a transparent double-ended threaded bolt means passing through said first and second connecting holes, a transparent flange, and at least two transparent stop nut means secured to said double-ended bolt means.

* * * * *